US008006414B2

(12) United States Patent
Leonard

(10) Patent No.: US 8,006,414 B2
(45) Date of Patent: Aug. 30, 2011

(54) MULTIPLE PURPOSE ATTACHMENT FOR A FRONT LOADER

(76) Inventor: Mark A Leonard, Kelso, WA (US)

( * ) Notice: Subject to any disclaimer, the term of this patent is extended or adjusted under 35 U.S.C. 154(b) by 0 days.

(21) Appl. No.: 12/039,414

(22) Filed: Feb. 28, 2008

(65) Prior Publication Data

US 2009/0217555 A1 Sep. 3, 2009

Related U.S. Application Data

(60) Provisional application No. 60/892,207, filed on Feb. 28, 2007.

(51) Int. Cl.
*E02F 3/96* (2006.01)

(52) U.S. Cl. ..... 37/406

(58) Field of Classification Search ..... 37/403–410, 37/468, 466, 195, 398, 442, 428; 414/724, 414/729, 739–740, 717, 686, 633, 648, 704
See application file for complete search history.

(56) References Cited

U.S. PATENT DOCUMENTS

| | | | | | |
|---|---|---|---|---|---|
| 878,641 | A | * | 2/1908 | Landholm | 414/717 |
| 1,386,911 | A | * | 8/1921 | Thomas | 414/648 |
| 1,524,135 | A | * | 1/1925 | Jordan | 37/442 |
| 2,326,338 | A | * | 8/1943 | Drott et al. | 37/409 |
| 2,328,715 | A | * | 9/1943 | Drott | 37/428 |
| 2,332,561 | A | * | 10/1943 | Droit | 37/406 |
| 2,387,656 | A | * | 10/1945 | Gledhill | 37/406 |
| 2,569,053 | A | * | 9/1951 | Healy | 414/633 |
| 2,812,595 | A | * | 11/1957 | Houghton et al. | 37/409 |
| 2,824,391 | A | * | 2/1958 | Roemer | 37/409 |
| 2,979,215 | A | * | 4/1961 | Brisson | 414/553 |
| 3,077,999 | A | * | 2/1963 | Svoboda | 37/409 |
| 3,209,474 | A | * | 10/1965 | Artman | 37/409 |
| 3,243,905 | A | * | 4/1966 | Ulrich | 37/406 |
| 3,250,028 | A | * | 5/1966 | Hunger et al. | 37/406 |
| 3,296,720 | A | * | 1/1967 | Sagerer | 37/406 |
| 3,336,684 | A | * | 8/1967 | Ulrich | 37/406 |
| 3,344,540 | A | * | 10/1967 | Ulrich | 37/406 |
| 3,375,595 | A | * | 4/1968 | Beltrami | 37/406 |

(Continued)

FOREIGN PATENT DOCUMENTS

JP 03183824 A * 8/1991

(Continued)

*Primary Examiner* — Robert E Pezzuto
(74) *Attorney, Agent, or Firm* — Merchant & Gould PC

(57) ABSTRACT

A multipurpose bucket for a front end loader is provided. The multipurpose bucket includes a second frame rotatably connected to a first frame to provide a pincer configuration and a scooping configuration. The first frame includes a bottom of the rear bucket wall; a pair of rear side walls with a plurality of pincer teeth; and a plurality of support arms extending from the rear bucket wall. The second frame includes a bucket floor having a pincer end and a scraper end; a pair of circular front side walls extending from the bucket floor to the pivot point, which increases the volume of the bucket and reduces spills; a plurality of pincer teeth extending from the pincer end of the front side walls; a rear plate extending from each of the pivots, attached to the front side walls, which forms the top of the rear bucket wall which increases the volume of the bucket; and a scraper blade extending from the scraper end of the bucket floor. The two frames are joined by the pivot as well as by at least one hydraulic cylinder. A method of operating the bucket is provided. Also included is a non-multipurpose bucket with rounded sides to increase volume and reduce spills.

8 Claims, 5 Drawing Sheets

U.S. PATENT DOCUMENTS

| | | | | | |
|---|---|---|---|---|---|
| 3,473,242 | A | * | 10/1969 | Martin | 37/442 |
| 3,842,999 | A | * | 10/1974 | Asbury | 414/724 |
| 3,908,844 | A | * | 9/1975 | Duffield | 414/724 |
| 4,422,819 | A | * | 12/1983 | Guest | 414/724 |
| 4,565,485 | A | * | 1/1986 | Wilman | 414/704 |
| 4,566,844 | A | * | 1/1986 | Campin | 414/726 |
| 4,890,400 | A | * | 1/1990 | Long | 37/241 |
| 4,928,410 | A | * | 5/1990 | Walters et al. | 37/409 |
| 4,974,350 | A | * | 12/1990 | Puckett | 37/409 |
| 5,121,557 | A | | 6/1992 | Moore | |
| 5,518,359 | A | * | 5/1996 | Pratt | 414/724 |
| 5,940,996 | A | * | 8/1999 | Cummings | 37/409 |
| 5,997,237 | A | | 12/1999 | Langenfeld et al. | |
| 6,374,520 | B1 | | 4/2002 | Westendorf et al. | |
| 6,582,177 | B1 | * | 6/2003 | Westendorf et al. | 414/686 |
| 6,612,051 | B2 | * | 9/2003 | Weyer et al. | 37/406 |
| 2001/0048873 | A1 | * | 12/2001 | Perry | 414/724 |

FOREIGN PATENT DOCUMENTS

| | | | | |
|---|---|---|---|---|
| JP | 04202917 | A | * | 7/1992 |

* cited by examiner

MULTIPLE PURPOSE ATTACHMENT FOR A FRONT LOADER

RELATED APPLICATION

This utility patent application claims the benefit under 35 United States Code §119(e) of U.S. Provisional Patent Application No. 60/892,207, which was filed Feb. 28, 2007.

TECHNICAL FIELD

The invention relates to a material handling device, and more particularly to a multipurpose bucket for use on a front end loader with a forklift attachment, and to a method for operating a multipurpose bucket and forklift attachment on a front end loader.

BACKGROUND ART

Multipurpose type buckets for use with front end loaders are known. In general, multipurpose buckets include a back or rearward frame and an opposed shell or movable frame. The back or rearward frame is attached to the loader arms of the front end loader, and the shell or movable frame rotates to provide a bucket for scooping or a pincer for grabbing and lifting items including logs and unbaled silage.

However, multipurpose buckets have not been received with significant commercial success. One reason for this lack of commercial success is the lack of scooping capacity due to the relatively small bucket. Multipurpose buckets are limited in size because of structural integrity reasons. Specifically, because the multipurpose bucket must serve as a pincer to pick up rocks and other hard and heavy objects, the surface forming the floor which serves as a the blades of the pincer must be significantly strengthened. This requires added material, which in turn reduces the carrying capacity of the bucket.

Attempts have been made to improve the usefulness of multipurpose buckets in a farming environment. U.S. Pat. No. 5,997,237 issued to Langenfeld is a multipurpose bucket with teeth on the bottom surface of the bucket. However, this approach does not increase the volume of the bucket. Langenfeld does curve the inner edges of the bucket to enhance the handling of bulky objects while the multipurpose bucket is in the pincer mode. The Langenfeld structure decreases the effective carrying capacity of the multipurpose bucket when operated as a scoop. U.S. Pat. No. 4,565,485, issued to Wilman and U.S. Pat. No. 4,566,844 issued to Campin are yet other approaches to designing multipurpose buckets and also fail to propose a design to increase the volume of the bucket.

U.S. Pat. No. 5,121,557 issued to Moore uses an articulating attachment to a connect standard bucket to a front loader. This may allow quick replacement of the standard bucket with another attachment and is not directed to a multipurpose bucket. The Moore design requires the entire bucket to be removed to attach another attachment.

U.S. Pat. No. 6,374,520 B1 issued to Westendorf is a bucket with curved side edges which could increase the volumetric capacity of the bucket. However, this patent is directed solely toward claiming a single purpose standard bucket that can be stacked upon identical buckets for easy transportation.

Accordingly, it would be desirable to provide a multipurpose bucket for a front loader that has an increased carrying capacity. It would also be desirable to provide such a bucket with the ability to attach attachments to it quickly.

SUMMARY OF THE INVENTION

A multipurpose bucket is provided which has an increased carrying capacity and has parts that are easily interchangeable which allows the bucket to be converted into a forklift. The bucket comprises two frames. The first frame is attached to the front end loader's arms and hydraulic cylinders by attachments on it's back wall. The first frame has a bottom and side walls with teeth that are used for gripping in conjunction with the side walls and bottom of the second frame. The first frame also has pivots in which the second frame is rotably attached.

The second frame has a floor with blades on both ends. The front blade acts as a scraper blade and the back end acts as a pincer blade. The second frame also has side walls on the rear end with teeth that act as pincers in conjunction with the first frame. The front of the side walls also have curved edges that extend toward the front of the frame. This acts to increase the carrying capacity of the bucket by adding more available surface area. A rear plate is also added to the bucket. The rear plate runs across the bucket from the pivots joining the first and second frames together. Attached to this rear plate is a hydraulic cylinder which in turn is attached to the first frame. This placement of the hydraulic cylinder to the rear plate allows the first and second frames to move rotatably between the pincer and scooping configuration while the rear plate increases available surface area in the scooping configuration. This increase of surface area increases the carrying capacity of the bucket while keeping dirt and rocks from falling upon the hydraulic cylinder and its attachments to the first and second frames which are used to rotate and open the second frame. The second frame can also be easily removed which allows the a forklift attachment to be quickly mounted in its place.

DISCLOSURE OF INVENTION

Figure 1:
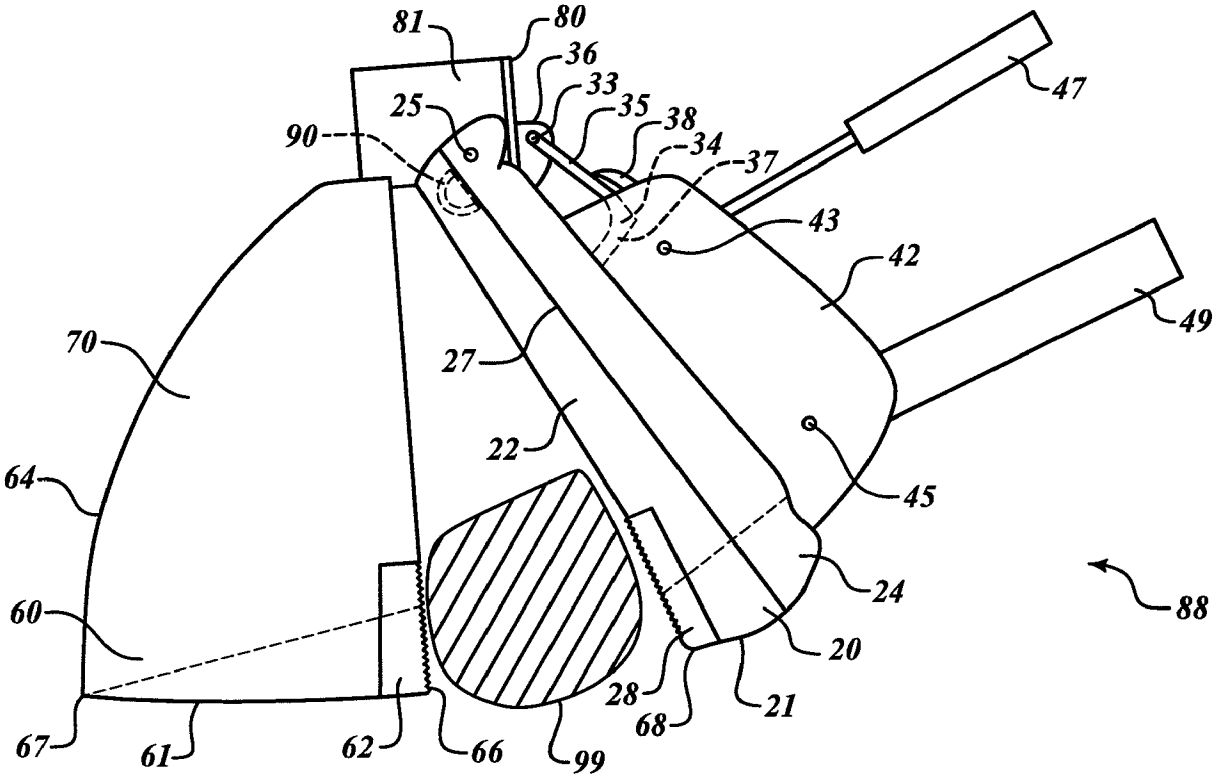
FIG. 1 is a side view of a preferred embodiment attached to a front loader in the pincer configuration.

Referring now to the drawings, the invention will be described in a preferred embodiment by reference to the numbers of the drawing figures wherein like numbers indicate like parts.

A representative embodiment of the present invention in the form of a multipurpose bucket 88 attached to a front end loader is shown in FIG. 1. FIG. 1 is a side view of the bucket attached to a front end loader. The multipurpose bucket 88 functions both as a pincer for grabbing articles, and as a bucket for scooping dry or wet materials. The bucket 88 can be referred to more simply as the bucket. When the bucket 88 functions as a pincer or grab, it can be used for picking up and moving materials such as baled and unbaled silage, including hay and straw, logs, or other articles which are bulky and difficult to scoop. When the bucket 88 functions as a scoop, it can be used for picking up and moving dry or wet materials such as manure, corn cobs, feed, dirt, sand, gravel, snow, and fertilizer.

The multipurpose bucket 88 consists of a first frame 20 and a second frame 60, which pivot relative to each other about left pivot 25 and right pivot 26. In typical operation of the bucket 88, the first frame 20 is relatively stable because it is attached to the front end loader. It is the second frame 60 which rotates about the left pivot 25 and right pivot 26 relative to the first frame 20. It should be appreciated, however, that the first frame 20 is capable of rotating in a manner common for buckets.

In FIG. 1, the bucket 88 is shown in a closed pincer position grasping a log 99. The closed pincer position refers to the configuration of the bucket 88 when it is acting as a pincer or grab and is holding an article. The open position refers to the configuration of the bucket 88 when it is not grabbing or grasping an article as a pincer or holding material as a bucket. Accordingly, the bucket 88 may be either about to grasp an article or it may have just released an article. Preferably, the bucket opens sufficiently wide to accept a bale of hay or a log.

Figure 2:
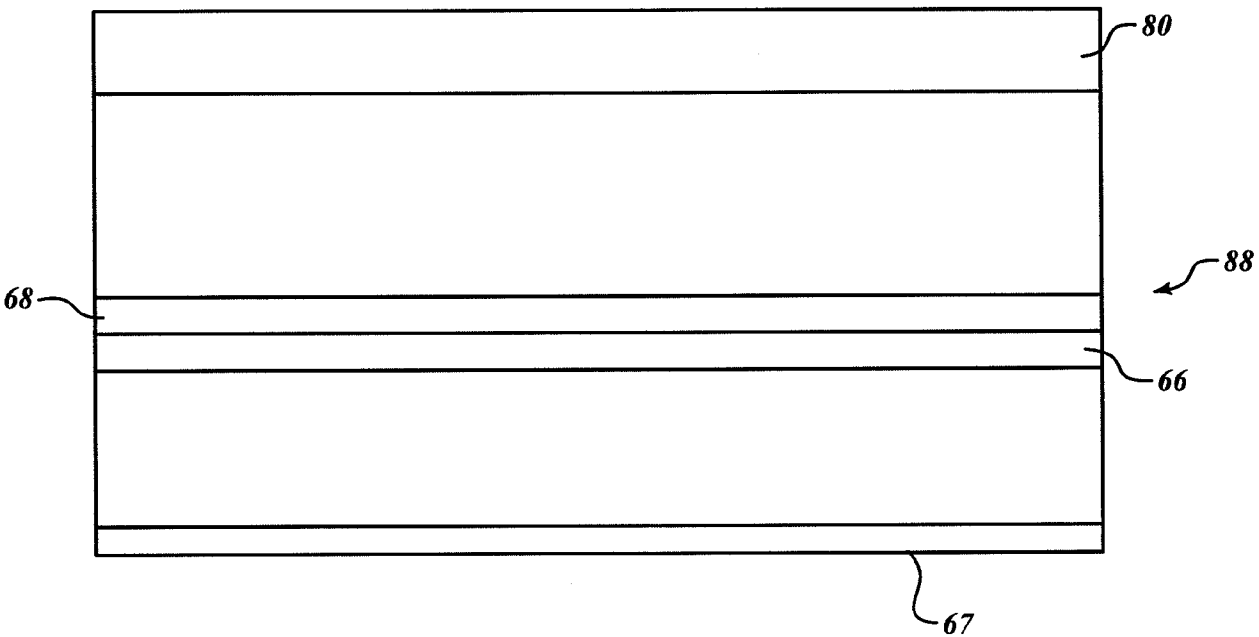
FIG. 2 is a front view of a preferred embodiment.

FIG. 2 shows the bucket 88 in a closed scooping position where the first frame 20 nests within the second frame 60 is in FIG. 2. When the bucket 88 is provided in this configuration, it can function as a scoop for transporting dry or wet materials. The materials can be released from the bucket 88 by separating the first frame 20 from the second frame 60, or the materials can be dumped out by rolling the bucket. When the loader is used as a bucket or scoop, the second frame 60 nests within the first frame 20 and the scraper blade 67 first engages the material, such as dirt and rocks, which is to be scooped up and moved. The first frame 20 has three sections. A section that will contact the dirt or other objects to be moved, a section that is attached to the front loader and a section that connects the first frame 20 with the second frame 60.

The section of the first frame 20 that will contact the objects to be moved is composed of a bottom 61, left side wall 22, right side wall 23, a rear wall 27, left side blade 28, right side blade 29, and pincer blade 68. Rear wall 27 serves as the main supporting structure of first frame 20. Rear wall 27 will not only support the weight of the objects to be carried, it will support its own weight when it is mounted to the front loader. Thus, rear wall 27 is made up of material of sufficient strength to withstand the stress that is typically encountered by a multipurpose bucket. Rear wall 27 has a back side which is back rear wall 24 which connects to the front loader. Rear wall 27 is also attached to second frame 60 via a hydraulic cylinder and several pivots. On the opposite side of rear wall 27, is the side of rear wall 27 which contacts the dirt or other objects to be moved. This side of rear wall 27 has left side wall 22 and right side wall 23 which have means such as teeth to grip objects such as logs when used in the pincer configuration with the side walls of the second frame. These side walls are made up of a sufficiently strong material to grab logs or heavy rocks without being damaged. Between these side walls is bottom 21 which is supported by left side wall 22 and right side wall 23. Bottom 21 helps the bucket scoop dirt or other objects. The front end of bottom 21 is a pincer blade 68. Pincer blade 68 and bottom 21 are structurally reinforced by using a thicker gauge of material in their construction and/or with a box beam structural configuration. This is because there is substantial force exerted on these structures when lifting a log or heavy rock while in the in the pincer configuration in conjunction with the second frame 60. As a result of the thicker gauge or box beam structure, multipurpose buckets have traditionally been able to carry less. However, in this invention, this lost volume is compensated for with the extra surface area on the curved edges on the side walls of the first frame as well as the addition of a rear plate.

The section of the first frame 20 that will be connected with the second frame 60 via a hydraulic cylinder 35 is on rear wall 27 as well as two separate pivot points on the sides of the bucket which are left pivot 25 and right pivot 26. The pivot points are on the sides of the bucket and permit rotation between the first and second frames. The rotation is controlled by hydraulic cylinder 35. Hydraulic cylinder 35 must be powerful enough not only to rotate the second frame 60 up and down, but also to grasp and hold heavy objects when the bucket is in the pincer configuration. Hydraulic cylinder 35 is attached to the first frame 20 by a center pivot attachment 37 via center pivot 34. Hydraulic cylinder 35 is attached to the second frame 60 by center pivot attachment 36 via center pivot 33. Hydraulic cylinder 35 is attached to the second frame's rear plate 80 via center pivot attachment 36. The rear plate 80 enables only one cylinder to be used in the center of the frames. The rear plate provides more surface area to increase bucket capacity when in the scooping configuration.

The section of first frame 20 that is attached to the front loader is on the rear wall 27. The two arms of the front loader and the front loader's hydraulic arms are attached at front end loader mount 42. Front end loader mount 42 has mounts for the four arms of the loader in which each arm is provided a pivot. This mount needs to be made of sufficiently strong material and be attached in a way that will withstand the stress of significant loads the bucket will carry. Front end loader mount Mount 42 interacts with the front loader's lower arms 49 and 50 via pivots 45 and 46 respectively. Front end loader mount 42 interacts with the front loader's upper hydraulic arms 47 and 48 via pivots 43 and 44 respectively. Front end loader mount 42 provides the front loader with means to support and control the bucket. The front loader, through front end loader mount 42, can scoop, dump, roll and otherwise manipulate the bucket in a way that is common to front loader mounted buckets. Such an attachment could be a forklift attachment that could be quickly mounted when second frame 60 is taken off.

Second frame 60 serves two purposes. It serves as the front end of the bucket when it scoops dirt and it serves as the front end of the pincer when the bucket grasps objects. The second frame 60 is comprised of bottom 61, left side wall 70, right side wall 71, left curved edge 64, right curved edge 65, left side blade 62, right side blade 63, pincer blade 66, scraper blade 67, left upper side plate 81, right upper side plate 82 and rear plate 80.

Second frame 60 is connected to the first frame at three points. First, left pivot 25 and right pivot 26 connect second frame 60 to first frame 20 along second frame left side wall 70 and right side wall 71. This allows second frame 60 to rotate about first frame 20 in a rotating motion. The rotation is controlled by hydraulic cylinder 35 which serves to attach first frame 20 and second frame 60 at the third point of attachment, center pivot 33. Hydraulic cylinder 35 is attached to the second frame 60 at center pivot 33 by center pivot attachment 36, which in turn is attached to rear plate 80. Rear plate 80 is attached to second frame 60 by left upper side plate 81 and right upper side plate 82 on the left and right sides of second frame 60 respectively. The attachment between the rear plate and the upper right and left side plates can be by welding or other similar means or may even be cast in one piece. As hydraulic cylinder 35 extends, second frame 60 rotates about pivots 25 and 26 and objects can then be grasped between the two frames.

In the current invention, the rear plate permits one hydraulic cylinder 35 to be used and keeps the hydraulic cylinder 35 away from the sides of the frames. The enlarged curved forward facing edges of frame 60, left curved edge 64 and right curved edge 65, give additional carrying capacity to the existing design as illustrated in FIG. 3 showing the multipurpose bucket 88 with rounded sides attached to a front end loader.

Figure 3:
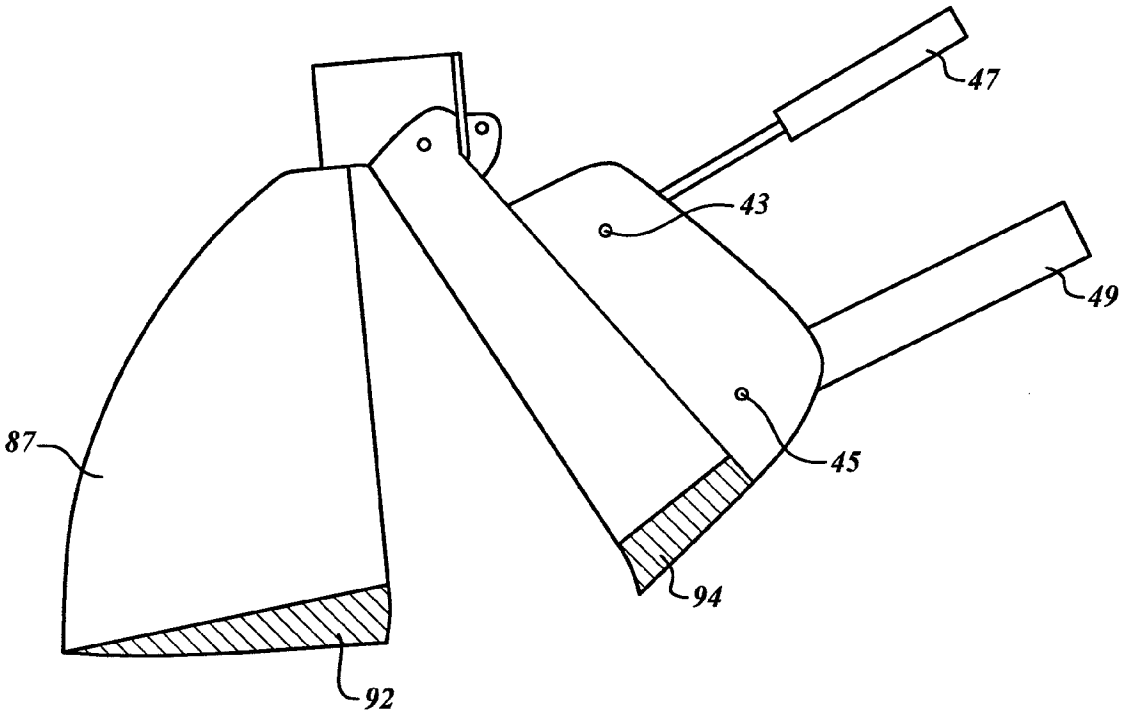
FIG. 3 is a cross section view of a preferred embodiment with curved sides to increase the volumetric capacity of a multipurpose bucket and also shows a beam construction which reinforces the scraper ends of the bottom of the multipurpose bucket.
Figure 5:
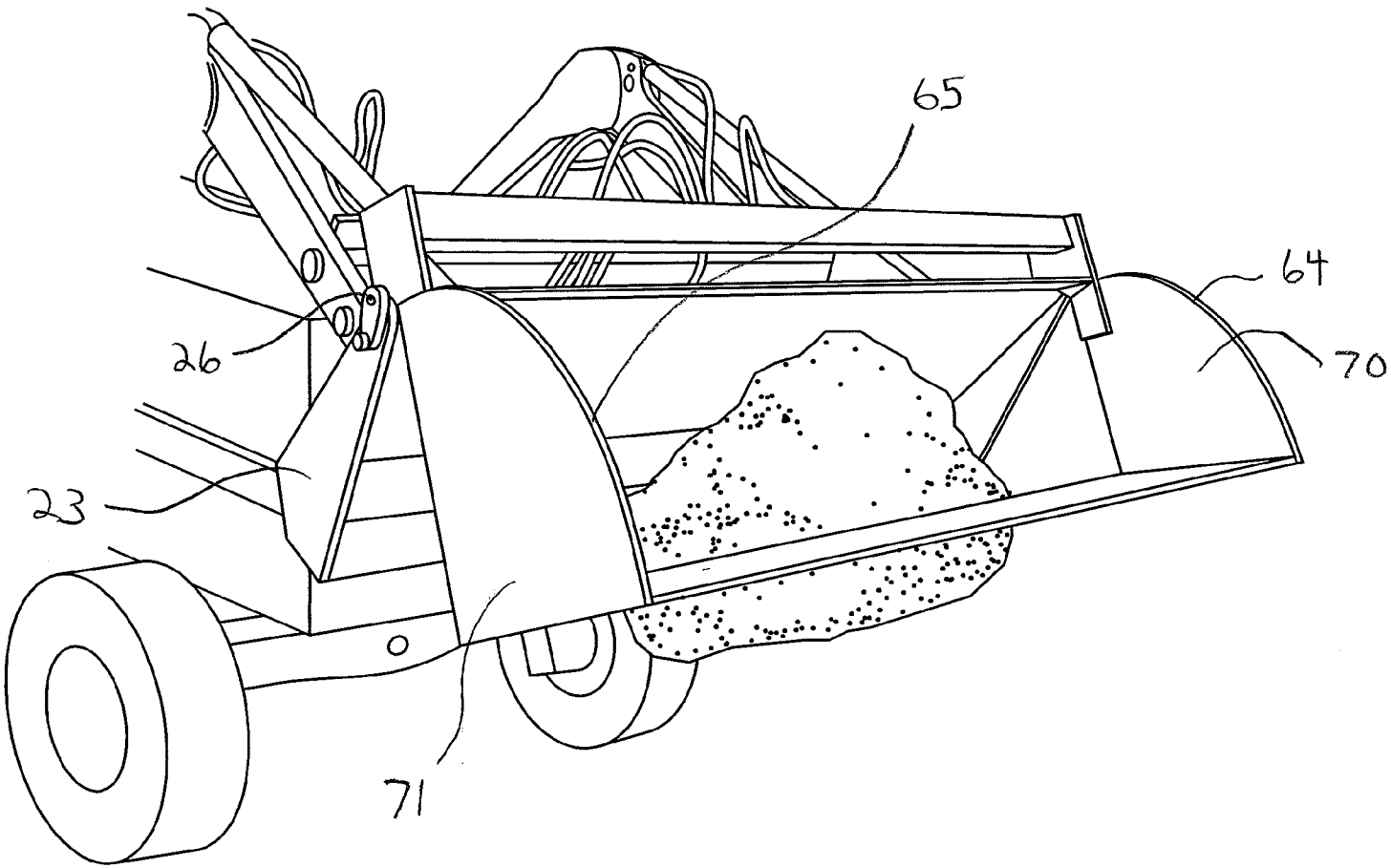
FIG. 5 is a photograph of a multipurpose bucket grasping a rock.

Additionally, FIG. 3. shows second frame pincher end 92 and first frame pincer end 94 which illustrates a box beam construction. The box beam construction on the pincer ends 92 and 94 are necessary to strengthen the bottom of the bucket 88 when used as a pincher. The enhanced strength resulting from the box beam construction prevents large, hard and heavy objects from deforming the bucket 88 when it is used to grasp. FIG. 5 is a perspective view of the front of a multipurpose bucket attached to a front end loader which illustrates the box beam construction.

Second frame 60 is also comprised of pincer blade 66. Pincer blade 66 runs along the entire edge of bottom 61. This blade serves as an outer blade which interacts with pincer blade 68 of first frame 20 when an object is grabbed in the pincer configuration. As with pincer blade 68 and bottom 21 of first frame 20, pincer blade 66 and bottom 61 need to be structurally reinforced. The reinforcement is typically though thickening the surfaces of pincer blade 66 and bottom 61. This extra material decreases the capacity of the bucket. However, the curved edges of the bucket, left curved edge 64 and right curved edge 65 as well as the addition of rear plate 80 enlarge the capacity of the bucket to compensate. Along with blade 66, second frame 60 can use left side blade 62 and right side blade 63 in conjunction with left side blade 28 and right side blade 29 mounted on first frame 20 to grasp objects while the bucket is in the pincer configuration. Like left side blade 28 and right side blade 29, left side blade 62 and right side blade 63 are equipped with grasping means. These means can be in the form of teeth or other similar methods in order to securely grasp slippery logs or oddly shaped rocks or any other difficult to grab and heavy objects. One skilled in the art would appreciate how the number of pincer teeth can be present.

Second frame 60 is also comprised of scraper blade 67. This like pincer blade 66 runs along the entirety of the bottom 61, except on side opposite of the pincer end. Scraper blade 67 like pincer blade 66 also benefits from the reinforced surfaces of bottom 61 and pincer blade 66. Scraper blade 67 would be the surface which first makes contact with dirt when the bucket is in the scooping configuration. Scraper blade could also be used to dislodge rocks, trees or to spread dirt evenly. The scraper blade 67 is provided as the initial blade for scooping dry or wet materials. The scraper blade 67, as well as the other blades described herein, should be prepared of a sufficiently strong material, such as high grade steel, to resist damage from hard objects including rocks and metal.

It should be appreciated that the bucket of the present invention is particularly useful for farm applications. In particular, the bucket is useful for farm applications requiring a bucket which is sufficiently large to hold large amounts of lightweight materials and strong enough to handle large bulky articles such as bales of hay or silage. In order to handle the large bulky articles, the separation of the pincer blades 66 and 68 when the bucket is provided in an open position is preferably greater than about 40 inches. Preferably, the bucket opens to a distance of greater than 60 inches, and may even be as great as about 67 inches. This allows the bucket to grab large bales of hay or silage. In addition, the bucket is preferably fairly wide. Preferably, the bucket is greater than about 70 inches wide. A preferred width is about 84 inches. This allows one to scoop large amounts of light weight products including hay and feed. A particular advantage of the invention is that the bucket can provide these large dimensions compared with the prior art, without being too heavy for use on conventional farm front end loader equipment.

It is expected that one can use the bucket in, for example, feed yards where food additives including fines, loose hay or silage, and corn stalks are mixes with a bale of hay. The bucket is capable of loading the loose materials as well as the bulky articles into a mixer wagon.

Example 1

A multipurpose bucket such as for use to pick up a log while attached to a front end loader may be made in accordance with the present invention. Bucket 88 is required to be attached to a front end loader in order to support the bucket and to power hydraulic cylinder 35. The front loader's lower hydraulic arms 49 and 50 are attached to the front end loader mount 42. Specifically, the front loader's lower hydraulic arms 49 and 50 are attached to pivots 45 and 46 respectively. The front loader's upper hydraulic arms 47 and 48 are attached to pivots 43 and 44 respectively. Once attached to the front loader's arms, the bucket can be controlled in a way common to front end loader attached buckets.

In addition, bucket 88 is required to be attached to the front end loader's hydraulic system to power hydraulic cylinder 35. This is accomplished through hydraulic hose 38. Hydraulic cylinder 35 is now enabled to rotate second frame 60 about first frame 20. This will allow bucket 88 to accomplish tasks like grasping objects.

The front loader can now raise the bucket into a position above a log 99. Hydraulic cylinder 35 now contracts to rotate second frame 60 about first frame 20 about pivots 25 and 26. Rear plate 80 allows placement of a single hydraulic cylinder to power the rotation of second frame 60 about first frame 20. Rear plate 80 runs across the length of the bucket and is attached to side walls 70 and 71 by plates 81 and 82 respectively. This allows first frame 20 and second frame 60 to open, which permits relatively large objects like logs to be grasped without reducing the scooping capacity of bucket 88.

Once bucket 88 is in pincer mode and the front loader positions the log 99 between first frame 20 and second frame 60, hydraulic cylinder 35 will cause the two frames to grasp the object. The object will encounter left side blade 28, right side blade 29 and pincer blade 68 on the first frame and left side blade 62, right side blade 63 and pincer blade 66 on second frame 60. The side blades have a plurality of teeth that can be varied as required. Pincer blades 68 and 66 are reinforced by being constructed with thick gauge material. This is required because the pincer blades encounter significant stress when grasping and moving very heavy objects like logs and rocks. The extra thickness of the blades, reduce the carrying capacity of the bucket, but this effect is offset by the curved sides 70 and 71 and the addition of rear plate 80.

Once the log is grasped, the front loader is used to carry the log to a desired location. Once, in the desired location, hydraulic cylinder 35 is contracted which rotates second frame 60 up about pivots 25 and 25 about first frame 20. This releases the pressure on the log from left side blade 28, right side blade 29 and pincer blade 68 on the first frame 20 and left side blade 62, right side blade 63 and pincer blade 66 on second frame 60. The bucket is now available to grasp another object.

Example 2

A multipurpose bucket such as for use to pickup and transport dirt while attached to a front end loader may be made in accordance with the present invention. Bucket 88 is required to be attached to a front end loader in order to support the bucket and to power hydraulic cylinder 35. The front loader's lower hydraulic arms 49 and 50 are attached to the front end loader mount 42. Specifically, the front loader's lower hydraulic arms 49 and 50 are attached to pivots 45 and 46 respectively. The front loader's upper hydraulic arms 47 and 48 are attached to pivots 43 and 44 respectively. Once attached to the front loader's arms, the bucket can be controlled in a way common to front end loader attached buckets.

In addition, bucket 88 is required to be attached to the front end loader's hydraulic system to power hydraulic cylinder 35. This is accomplished through hydraulic hose 38. Hydraulic cylinder 35 is now enabled to rotate second frame 60 about first frame 20. This will allow bucket 88 to accomplish tasks like picking up large amount of dirt or other loose material. Bucket 88 is positioned above the pile of loose material desired to be moved. Hydraulic cylinder 35 contracts so that side blades 62 and 63 are parallel or near parallel with side blades 28 and 29, while second frame 60 rotates about first frame 20 about pivots 25 and 26. These side blades along with pincer blade 66 and 68 will be lowered into the pile of dirt. Once lowered into the pile by using the front loader's arms 47, 48, 49 and 50, hydraulic cylinder 35 is extended and pushes second frame 60 into first frame 20. This results in side blade 62 contacting side blade 28 and side blade 63 contacting side blade 29, as well as pincer blade 66 contacting pincer blade 68. Dirt is trapped inside the bucket between the side blades and pincer blades. The capacity of the bucket is enhanced by the curved shaped side walls 70 and 71 as well as the rear plate 80.

Once the bucket is placed above the desired position, hydraulic cylinder 35 contracts and second frame 60 rotates away from first frame 20 about pivots 25 and 26. As the left side blade 62 loses contact with left side blade 28, and as right side blade 63 loses contact with right side blade 29, and as pincer blade 66 loses contact with pincer blade 68, the dirt now falls out of the bucket.

Example 3

A multipurpose bucket such as for use to scoop dirt while attached to a front end loader may be made in accordance with the present invention. Bucket 88 is required to be attached to a front end loader in order to support the bucket and to power hydraulic cylinder 35. The front loader's lower hydraulic arms 49 and 50 are attached to the front end loader mount 42. Specifically, the front loader's lower hydraulic arms 49 and 50 are attached to pivots 45 and 46 respectively. The front loader's upper hydraulic arms 47 and 48 are attached to pivots 43 and 44 respectively. Once attached to the front loader's arms, the bucket can be controlled in a way common to front end loader attached buckets.

In addition, bucket 88 is required to be attached to the front end loader's hydraulic system to power hydraulic cylinder 35. This is accomplished through hydraulic hose 38. Hydraulic cylinder 35 is now enabled to rotate second frame 60 about first frame 20. This will allow bucket 88 to remain closed while scooping dirt.

In order to scoop dirt or any other comparable material, the front end loader is used to orient the bucket into the desired position. In one embodiment, the loader would be angled down into or parallel with the ground and the loader driven forward into a pile of dirt. Scraper blade 67 would be the first part of the bucket to contact the dirt. Scraper blade 67 benefits by reinforced with thicker gauge material as significant stress is imposed on it while scooping objects like piles of heavy rocks. For similar reasons, bottom 61, and bottom 21 are also reinforced. As the front loader is driven forward, dirt fills the bucket. The front loader's upper hydraulic arms 47 and 48 are then contracted which scoops the dirt in the bucket. The enlarged side walls of the second frame 60, left side wall 70 and right side wall 71 enable larger amounts of dirt to be carried and further limit spills. In addition, rear plate 80 also aids in adding capacity and limiting spills. When bucket 88 is in the scooping configuration, rear plate 80 fits flush with rear wall 27. Thus, when bucket 88 is scooping dirt, with scraper blade 67 at a height greater than bottom 61 and bottom 21, dirt will rest against rear plate 80 and not fall into the hydraulic cylinder 35 or the front end loader mount 42. This added capacity compensates for the thicker gauge material used to strengthen scraper blade 67, pincer blade 66, pincer blade 68 and bottom 21.

Once the bucket is moved into the desired position, the front end loader can turn the bucket into a position where the dirt can be emptied into a pile. Bucket 88 can be opened into the grasping position to help spread the dirt. Hydraulic cylinder would rotate second frame 60 so that side blades 62 and 63 would be parallel or near parallel with side blades 28 and 29 respectively. This would enable the pincer blade 66 and pincer blade 68 to smooth the pile in a flat surface by placing the blades against the dirt and driving the front loader as desired. Additional movement may be made by using the front loader's arms as desired. Alternately the bucket 88 could remain in the scooping position and the bucket 88 could smooth a dirt pile using only scraper blade 67 in a similar manner.

Example 4

In example embodiments, a forklift attachment or hay bale carrier is attached to a front end loader. Specifically, forklift attachment 91 is connected to first frame 20, in place of second frame 60. This allows the forklift attachment 91 to be pivoted in several angles to aid in the balancing of heavy loads such as hay bales or pallets.

First, the front loader's lower hydraulic arms 49 and 50 are attached to the front end loader mount 42. Specifically, the front loader's lower hydraulic arms 49 and 50 are attached to pivots 45 and 46 respectively. The front loader's upper hydraulic arms 47 and 48 are attached to pivots 43 and 44 respectively. Once attached to the front loader's arms, first frame 20 is connected to front end loader mount 42 and can be oriented in a way common to front end loader attached buckets.

Figure 4:
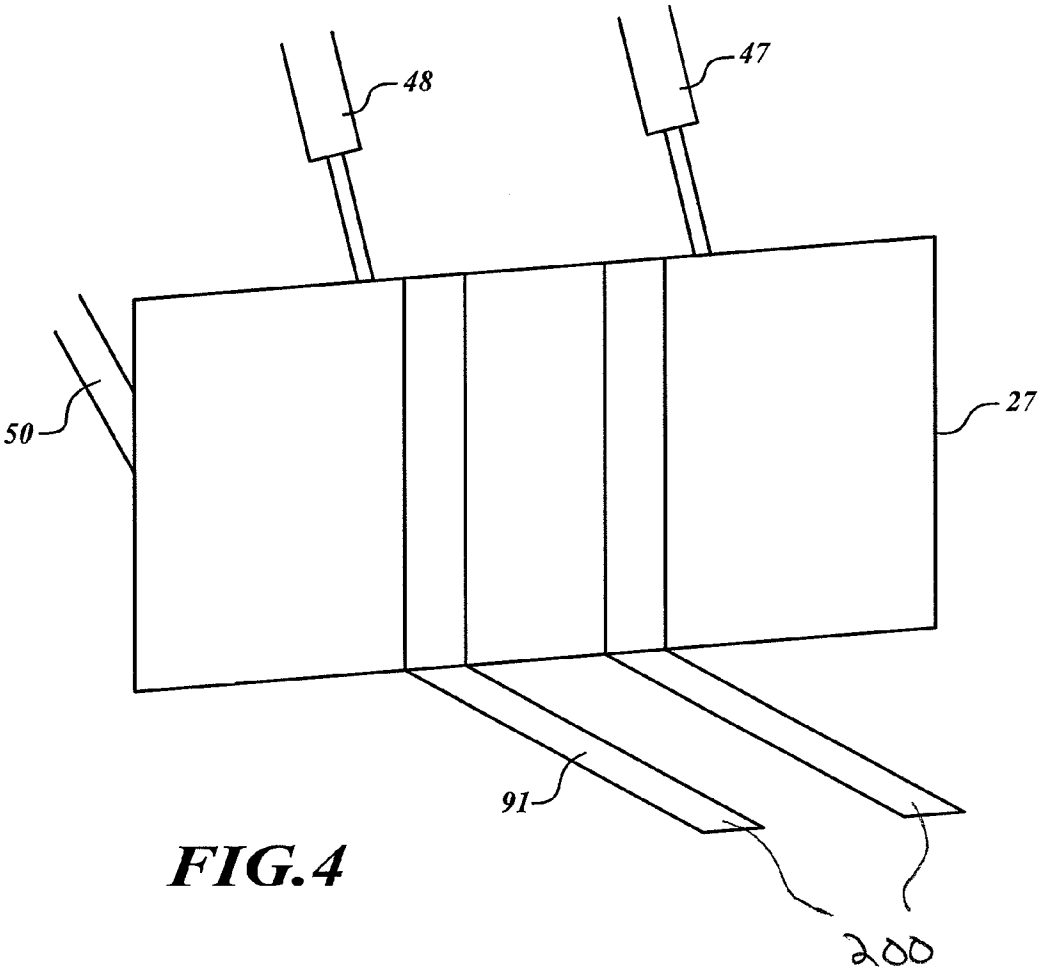
FIG. 4 is a perspective view of a forklift attachment attached to the first frame with the second frame detached.

Second, forklift attachment 91 is installed in place of second frame 60 as shown in FIG. 4. This can be done by installing forklift attachment 91 to first frame 20 via pivots 25 and 26. In example embodiments, forklift attachment 91 is composed of a frame, side plates and back plate. The forklift attachment is constructed in a similar manner as a second bucket. Specifically, the frame has two side plates attached on the frame's sides and a back plate attached on the frame's back. Attachment of the side plates to the frame can be done by welding or other suitable method.

Additionally, forklift attachment 91 is not only attached to pivots 25 and 26, but is also attached to the frame's back plate via hydraulic cylinder 35, enabling the orientation angles of forklift attachment 91 to be changed. Hydraulic cylinder 35 attached to forklift attachment 91 by a center pivot in a manner similar to how hydraulic cylinder 35 is attached to the second frame in other embodiments.

Forklift attachment 91 has a plurality of prongs 200 used to transport large cylindrical hay bales. Prongs 200 can be of any shape, length, width, orientation or made from any material suitable to those in the ordinary skill of the art.

The front loader can then orient forklift attachment 91 into a pile of hay or similar material and pick it up. This is accomplished by the front loader's upper hydraulic arms 47 and 48 contracting and orienting the outer tips of the forklift attachment 91 above the bottom of the rear wall 27. In this configuration, the front end loader operator can adjust the front loader's upper hydraulic cylinder arms 47 and 48 in order to properly balance the load. By rolling the bucket back, the load comes in closer to the front end loader. This changes the center of gravity of the load relative to the front end loader, which makes the load easier to balance and carry. An additional advantage over a fork lift attachment that is not pivotable, such as a forklift attachment that is merely welded to rear wall 27, is the ability for hydraulic cylinder 35 to pivot attachment 91 about pivots 25 and 26. This allows a user to pivot loads using hydraulic cylinder 35 and not using the arms of the front end loader or if the arms are used, to a minimal degree. This enables the user to balance loads lower to the ground which increases stability and safety.

While the invention has been described with reference to preferred embodiments thereof, it will be understood that various changes and additions may be made therein without departing from the scope and spirit of the essential features involved.

INDUSTRIAL APPLICABILITY

The industrial applicability of this invention may be to scoop and transport dirt in a first mode of operation and to grasp, lift and transport bulky objects such as a boulders, hay bales and the like in a second mode of operation.

What is claimed is:

1. A multiple purpose front end loader bucket for attachment to a front end loader having lift arms and hydraulic cylinders, the loader bucket comprising:

a first frame comprising:

a bottom, rear side walls, a rear back wall, first and second pivots for attachment to the lift arms of the front end loader, and third and fourth pivots for attachment to a second frame;

said first and second pivots mounting to the first frame and having a pair of pivot mounts, each having a lower pivot for attachment to the lift arms of the front end loader and an upper pivot for attachment to the hydraulic cylinders of a front end loader to pivot said first frame at different angles;

a lower section of said side walls, each having protruding teeth to engage and hold objects;

said second frame comprising:

a bucket floor and front side walls defining an open front face;

said front side walls each having a rearwardly directed pincer end and a forwardly directed scraper end;

said front side walls each having forward facing edges with a continuous upwardly curved shape along a front face and extending from the bucket floor to a third pivot point and a forth pivot point, rotatably attaching said second frame to said first pivot point and said second pivot point on said first frame, said continuous upwardly curved shape increasing the volume of the bucket;

grasping means extending rearwardly from the front side walls;

a scraper blade extending across the front of the bucket from said scraper end to each front side wall;

a rear plate extending across said second frame from said third pivot point to said fourth pivot point, said rear plate attached to the front walls by a first upper side plate and a second upper side plate, said rear plate positioned above said rear bucket wall when disposed fully into the scrapping position, extends rearward to stop dirt from falling over said rear wall; and the first frame rotatably connected to the second frame along said third pivot point and said forth pivot point to provide rotation of the first and second frames between a pincer configuration and a scooping configuration.

2. The bucket according to claim 1, further comprising a center hydraulic cylinder having a first end attached to the rear plate and a second end attached to the first frame, to provide rotation of said first frame relative to said second frame about the pivot points.

3. The bucket according to claim 1, wherein the grasping means extending from the front side walls and the rear side walls comprise a plurality of serrated teeth.

4. The bucket according to claim 1, wherein the first frame comprises a quick attachment receiver.

5. The bucket according to claim 1, wherein the second frame further comprises a blade at the pincer end of said bucket.

6. The bucket according to claim 1, wherein the second frame is detachable and other attachments can be interchangeably mounted in place of the second frame.

7. The bucket according to claim 6, wherein one of the other attachments is a forklift attachment comprising a mounting frame and plurality of bars.

8. A method of operating a multiple purpose front end loader in two configurations, the front end loader including a bucket with a first frame and a second frame having an open front face and sidewalls with upwardly curved forward facing edges curving continuously along a front face of the bucket and having a rear plate attached to the side walls by a first upper side plate and a second upper side plate and a forklift attachment interchangeable with the second frame, comprising:

operating the loader with the second frame of the bucket attached to the first frame of the bucket;

detaching the second frame from the first frame;

mounting the forklift attachment in place of the second frame; and balancing said bucket with the forklift attachment mounted for optimal weight distribution.

* * * * *